US010663209B2

(12) United States Patent
Mynderse et al.

(10) Patent No.: US 10,663,209 B2
(45) Date of Patent: May 26, 2020

(54) REFRIGERATOR APPLIANCE AND METHOD WITH REDUCED FREEZER DOOR OPENING FORCE

(71) Applicant: Haier US Appliance Solutions, Inc., Wilmington, DE (US)

(72) Inventors: David Mynderse, Louisville, KY (US); Bradford Gasior, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 602 days.

(21) Appl. No.: 15/420,133

(22) Filed: Jan. 31, 2017

(65) Prior Publication Data

US 2018/0216867 A1 Aug. 2, 2018

(51) Int. Cl.

| | |
|---|---|
| ***A47J 47/00*** | (2006.01) |
| ***F25D 17/04*** | (2006.01) |
| ***F25C 5/20*** | (2018.01) |

(52) U.S. Cl.

CPC ..... *F25D 17/047* (2013.01); *F25C 5/22* (2018.01); *F25D 2600/02* (2013.01); *F25D 2700/04* (2013.01)

(58) Field of Classification Search

CPC . F25D 17/047; F25D 2600/02; F25D 2700/04

USPC ..... 454/183

See application file for complete search history.

(56) References Cited

U.S. PATENT DOCUMENTS

| | | | | |
|---|---|---|---|---|
| 2013/0099715 | A1* | 4/2013 | Fuhge | E05F 15/611 318/484 |
| 2015/0107285 | A1* | 4/2015 | Mitchell | F25D 23/04 62/186 |
| 2016/0333625 | A1* | 11/2016 | Kempfle | F25D 23/028 |
| 2017/0167780 | A1* | 6/2017 | Jeong | B67D 1/0014 |

FOREIGN PATENT DOCUMENTS

| | | | |
|---|---|---|---|
| EP | 2597403 | A2 | 5/2013 |
| JP | H10300309 | A | 11/1998 |
| KR | 20000043140 | A | 7/2000 |
| WO | WO2014160908 | A2 | 10/2014 |

* cited by examiner

*Primary Examiner* — Helena Kosanovic

(74) *Attorney, Agent, or Firm* — Dority & Manning, P.A.

(57) ABSTRACT

A refrigerator appliance with a freezer chamber in fluid communication with a duct door of a dispenser assembly of the refrigerator appliance. Upon a proximity sensor detecting a user within a proximity range, the duct door is opened to reduce the pressure differential between the freezer chamber and the surrounding ambient air, thereby reducing the opening force required to open the freezer door.

4 Claims, 5 Drawing Sheets

REFRIGERATOR APPLIANCE AND METHOD WITH REDUCED FREEZER DOOR OPENING FORCE

FIELD OF THE INVENTION

The present subject matter relates generally to refrigerator appliances and more particularly to refrigerator appliances configured to reduce the opening force of a freezer door.

BACKGROUND OF THE INVENTION

Certain refrigerator appliances include a freezer chamber that is accessible by a freezer door. Opening the freezer door can sometimes be difficult due to the vacuum created by the pressure differential between the relatively low pressure air within the freezer chamber and the surrounding higher pressure ambient air. In particular, if the freezer chamber has not been accessed for a certain period of time, the pressure differential between the air within the freezer chamber and ambient air can increase or build up. When a user attempts to open the freezer door, the freezer door resists opening as outside air pressure forces the door toward the relatively lower pressure freezer chamber. Accordingly, opening the freezer door can be challenging, strenuous, and inconvenient to users.

Accordingly, a refrigerator appliance and a method therefore that reduces the opening force required to open the freezer door of the refrigerator appliance would be useful.

BRIEF DESCRIPTION OF THE INVENTION

The present subject matter provides a refrigerator appliance defining a freezer chamber. The freezer chamber is accessible by a freezer door. The freezer chamber is in fluid communication with a duct door, such as a duct door of an ice dispensing assembly. The refrigerator appliance includes a proximity sensor that detects when users are within a proximity range of the refrigerator appliance. Upon such detection, the duct door is opened to reduce the pressure differential between the interior air of the freezer chamber and the surrounding ambient air. Thus, the opening force required to open the freezer door is reduced. Additional aspects and advantages of the invention will be set forth in part in the following description, or may be apparent from the description, or may be learned through practice of the invention.

In one exemplary embodiment, a method for reducing a freezer door opening force of a refrigerator appliance is provided. The refrigerator appliance defines a freezer chamber accessible by a freezer door and includes a duct door in fluid communication with the freezer chamber. The method includes: monitoring for users within a proximity range of the refrigerator appliance; detecting at least one user within the proximity range; and opening the duct door upon detection of the user so as to provide fluid communication between the freezer chamber and air exterior to the refrigerator appliance.

In an additional aspect, the method may include: determining whether the duct door has been opened within a predetermined time.

In another aspect, if the duct door has been opened within the predetermined time, the method may include: keeping the duct door closed at least until after the predetermined time has elapsed; monitoring for users within the proximity range of the refrigerator appliance after the predetermined time has elapsed; detecting the at least one user within the proximity range; and opening the duct door upon detection of the user.

In another exemplary embodiment, a refrigerator appliance is provided. The refrigerator appliance defines a freezer chamber accessible by a freezer door. The refrigerator appliance includes a duct door in fluid communication with the freezer chamber and selectively adjustable between an open and a closed position, and when in the open position, the freezer chamber is in fluid communication with air exterior to the refrigerator appliance, and in the closed position, the freezer chamber is not in fluid communication with air exterior to the refrigerator appliance. The refrigerator appliance also includes a motor configured to actuate the duct door between the open and the closed position. The refrigerator appliance additionally includes a proximity sensor for detecting users within a proximity range of the refrigerator appliance. The proximity sensor is in operative communication with the motor. When the proximity sensor detects a user within the proximity range, the motor is configured to actuate the duct door to the open position for a predetermined open time.

In another aspect, the refrigerator appliance may include a controller in operative communication with the proximity sensor and the motor, where the controller configured to: obtain a communication from the proximity sensor that the user is within proximity range of the refrigerator appliance; and activate the motor to open the duct door for the predetermined open time when the proximity sensor detects the user within the proximity range.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
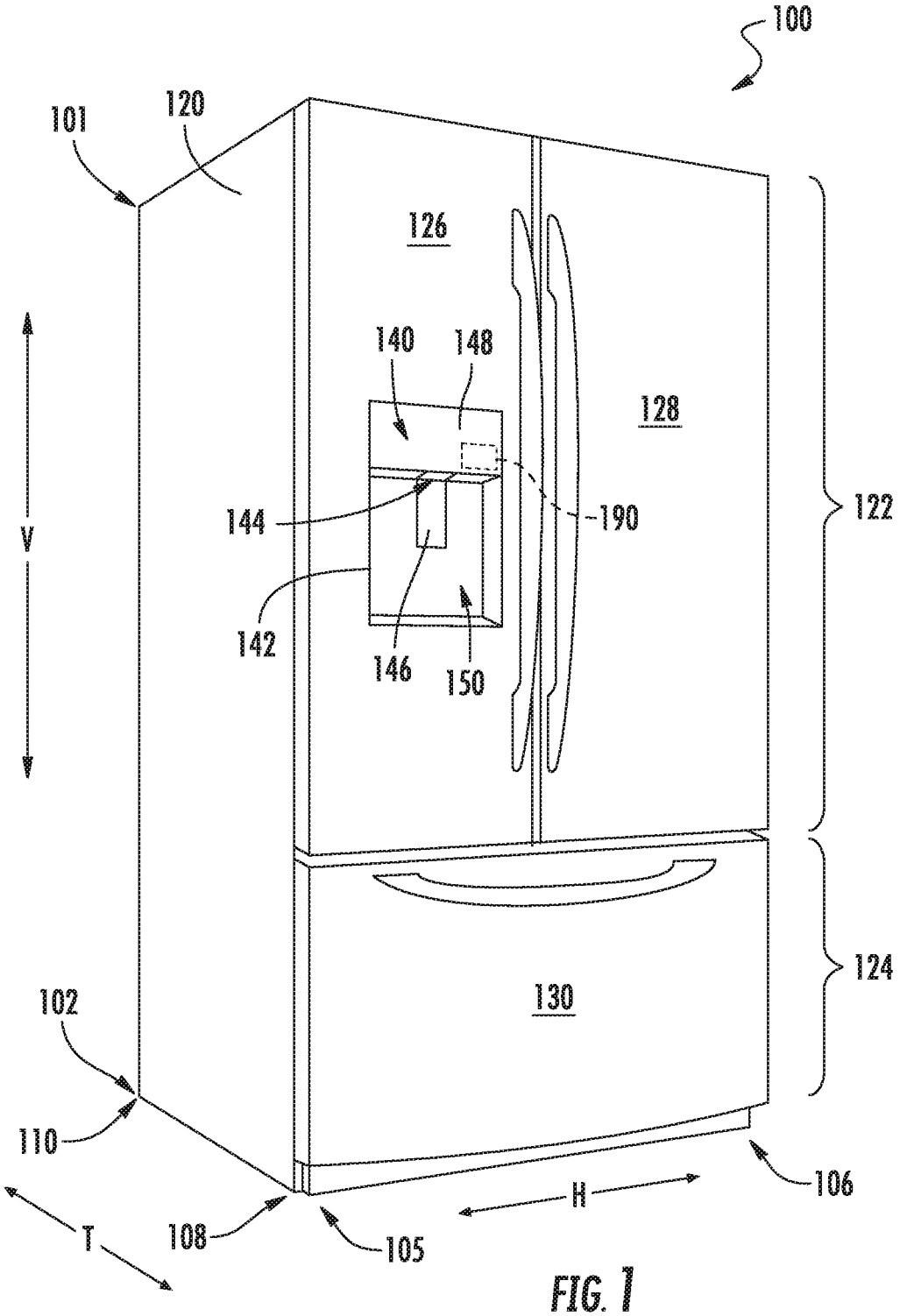
FIG. 1 provides a perspective view of a refrigerator appliance according to exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to exemplary embodiments of the present subject matter. Refrigerator appliance 100 includes a cabinet or housing 120 that extends between a top 101 and a bottom 102 along a vertical direction V. Housing 120 also extends between a first side 105 and a second side 106 along a horizontal direction H and between a front 108 and a rear 110 along a transverse direction T. Vertical direction V, horizontal direction H, and transverse direction T are mutually perpendicular and form an orthogonal direction system.

Housing 120 defines chilled chambers for receipt of food items for storage. In particular, housing 120 defines a fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present subject matter apply to other types and styles of refrigerator appliances such as, e.g., a top mount refrigerator appliance or a side-by-side style refrigerator appliance. Moreover, the benefits of the present subject matter may likewise apply to freezer appliances, e.g., upright freezers. Consequently, the description set forth herein is for exemplary purposes only and is not intended to be limiting in any aspect to any particular refrigerator or freezer chamber configuration.

Refrigerator doors 126, 128 are rotatably hinged to an edge of housing 120 for selectively accessing fresh food chamber 122. In addition, a freezer door 130 is arranged below refrigerator doors 126, 128 for selectively accessing freezer chamber 124. Refrigerator doors 126, 128 and freezer door 130 are shown in a closed configuration in FIG. 1.

Refrigerator appliance 100 includes a dispensing assembly 140 for dispensing liquid water and/or ice. Dispensing assembly 140 includes a dispenser 142 positioned on or mounted to an exterior portion of refrigerator appliance 100, e.g., on one of doors 126, 128. Dispenser 142 defines a discharging outlet 144 in which ice and/or liquid water may exit dispenser 142. An actuating mechanism 146, shown as a paddle in FIG. 1, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle.

Discharging outlet 144 and actuating mechanism 146 are located in a dispenser recess 150. Dispenser recess 150 is positioned at an elevation convenient for users to access ice or water from dispenser 142 without need to bend over or open doors 126, 128. In the exemplary embodiment of FIG. 1, dispenser recess 150 is positioned at a level that approximates the chest level of an adult user.

A user interface panel 148 is provided for controlling a mode of operation of dispenser 142 and other systems of refrigerator appliance 100. For example, user interface panel 148 includes a plurality of user inputs (not labeled), such as a water dispensing button and an ice-dispensing button, for selecting a desired mode of operation, such as crushed or non-crushed ice. In one embodiment, user interface panel 148 may include input components, such as one or more of a variety of electrical, mechanical or electro-mechanical input devices including rotary dials, push buttons, and touch pads. User interface panel 148 may include a display component, such as a digital or analog display device designed to provide operational feedback to users.

Operation of refrigerator appliance 100 is controlled by a computing device or controller 190. Controller 190 may be operatively coupled to user interface panel 148 for user manipulation to select features and operations of dispenser 142, and controller 190 may also be operatively coupled with other systems and operational components of refrigerator appliance 100 as well. For instance, controller 190 can be in operative communication with a sealed system, an ice making assembly, and/or various motors, fans, heaters, etc. of refrigerator appliance 100. In such an embodiment, input/output ("I/O") signals may be routed between controller 190 and various operational components of refrigerator appliance 100. Thus, controller 190 can selectively activate and operate these various components. Controller 190 can be positioned in a variety of locations throughout refrigerator appliance 100. In FIG. 1, controller 190 is located within refrigerator door 126 proximate user interface panel 148.

Controller 190 includes one or more memory devices and one or more processors (not labeled). The processor or processors can be any combination of general or special purpose processors, CPUs, or the like that can execute programming instructions or control code associated with operation of dispenser 142 or other systems of refrigerator appliance 100 more generally. The memory devices may represent random access memory such as DRAM or read only memory such as ROM or FLASH. In one embodiment, the processor executes programming instructions stored in memory. The memory may be a separate component from the processor or may be included onboard within the processor. Alternatively, controller 190 may be constructed without using a processor, e.g., using a combination of discrete analog and/or digital logic circuitry (such as switches, amplifiers, integrators, comparators, flip-flops, AND gates, and the like) to perform control functionality instead of relying upon software. Various components of refrigerator appliance 100 may be in communication with controller 190 via one or more signal lines or shared communication busses (not labeled). Controller 190 may also include a timer or internal clock (not labeled) for timing certain operations of refrigerator appliance 100.

Figure 2:
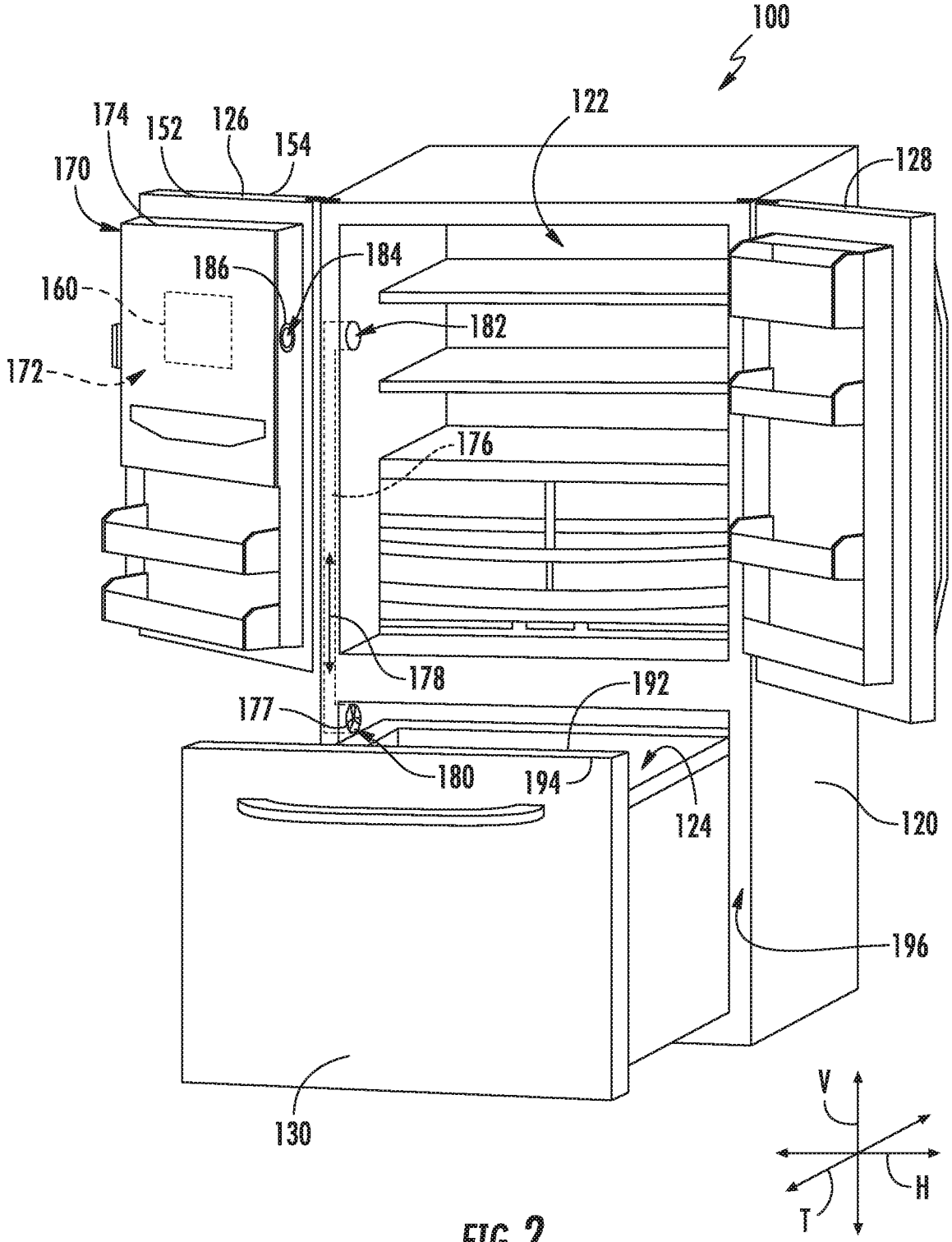
FIG. 2 provides a perspective view of the refrigerator appliance of FIG. 1 with refrigerator doors and a freezer door shown in an open configuration to reveal a fresh food chamber and a freezer chamber of the refrigerator appliance according to exemplary embodiments of the present subject matter.

FIG. 2 provides a front perspective view of refrigerator appliance 100 of FIG. 1 with refrigerator doors 126, 128 and freezer door 130 shown in an open configuration to reveal fresh food chamber 122 and freezer chamber 124 of refrigerator appliance 100 according to exemplary embodiments of the present subject matter. As shown, refrigerator door 126 of refrigerator appliance 100 includes an inner side 152 and an outer side 154. The inner side 152 generally defines the interior of fresh food chamber 122 when refrigerator door 126 is in a closed position as shown in FIG. 1, while outer side 154 is generally opposite inner side 152 and defines the exterior of refrigerator appliance 100.

A compartment 170 is defined in refrigerator door 126, such as on or in inner side 152 of refrigerator door 126. For this embodiment, compartment 170 defines an interior chamber 172 that houses an ice making assembly 160. Although not shown, ice making assembly 160 may include an auger, fan, heating elements, a storage bin, temperature sensors, an extruder, and/or other suitable components that facilitate ice making. A compartment door 174 provides access to interior chamber 172 and is rotatably hinged to an edge of compartment 170 for accessing interior chamber 172, or may otherwise be connected to compartment 170, refrigerator door 126, etc., such that compartment door 174 may be movable between open and closed positions. In a closed position, as shown in FIG. 2, compartment door 174 defines and encloses interior chamber 172. When compartment door 174 is in an open position (not shown), ice making assembly 160 and more generally interior chamber 172 of compartment 170 can be accessed.

In general, compartment 170 and various components thereof, including interior chamber 172 and compartment door 174, may be insulated to reduce heat exchange between compartment 170 and, for example, fresh food chamber 122. Due to the insulation which encloses insulated compartment 170, the temperature within insulated interior chamber 172 can be maintained at a variety of levels different from the temperature in fresh food chamber 122, which may be especially useful in making ice. In particular, insulated compartment 170 can be maintained at or below freezing temperatures such that ice can be made by ice making assembly 160, stored in compartment 170 for future use, and dispensed by dispenser 142 upon user command.

To facilitate freezing temperatures in compartment 170, compartment 170 is in fluid or airflow communication with freezer chamber 124. As shown in FIG. 2, for example, a duct 176 extends between and provides fluid communication between compartment 170 and freezer chamber 124. Duct 176 may, as desired, flow air 178 from freezer chamber 124 to compartment 170 or vice versa. One or more fans 177 may be located within compartment 170 or within freezer chamber 124 for pushing or drawing airflow between compartment 170 and freezer chamber 124.

Duct 176 may include, for example, a freezer opening 180 and a fresh food chamber opening 182. Freezer opening 180 is defined in freezer chamber 124, while fresh food chamber opening 182 is defined in fresh food chamber 122. In FIG. 2, fan 177 is positioned within or proximate freezer opening 180. Duct 176 may generally be disposed within refrigerator appliance 100, such as e.g., within the various walls defining the chambers 122, 124. When refrigerator door 126 is in a closed position, an aperture 184 defined by compartment 170 mates with fresh food chamber opening 182 to allow for fluid communication between freezer chamber 124 and compartment 170. A gasket 186 or other means such as a pocket access door (not shown) may prevent air leakage from aperture 184 when refrigerator door 126 is in an open position.

In other exemplary embodiments, refrigerator appliance 100 may have more than one duct for providing fluid communication to compartment 170. Moreover, it will be appreciated that compartment 170 can be in fluid communication with freezer compartment 124 via other methods. For example, in a side-by-side refrigerator appliance configuration in which a dispenser is disposed on a refrigerator door enclosing the freezer chamber side, no duct between the compartment/ice making assembly may be necessary as the ice making assembly has direct access to below freezing temperatures.

Referring still to FIG. 2, freezer door 130 includes an inner side 192 and an outer side 194. The inner side 192 generally defines a portion of the interior of freezer chamber 124 along front 108 of refrigerator appliance 100 when freezer door 130 is in a closed position as shown in FIG. 1, while outer side 194 is generally opposite inner side 192 and defines a portion of the exterior of the refrigerator appliance 100. Although not shown, a gasket is disposed along the outer perimeter of inner side 192 of freezer door 130. The gasket is configured to mate with a lip 196 of housing 120 when in the closed position. In this manner, freezer door 130 is in sealing communication with housing 120 to keep chilled air from leaking into the surrounding ambient air when in the closed position as depicted in FIG. 1.

Figure 3:
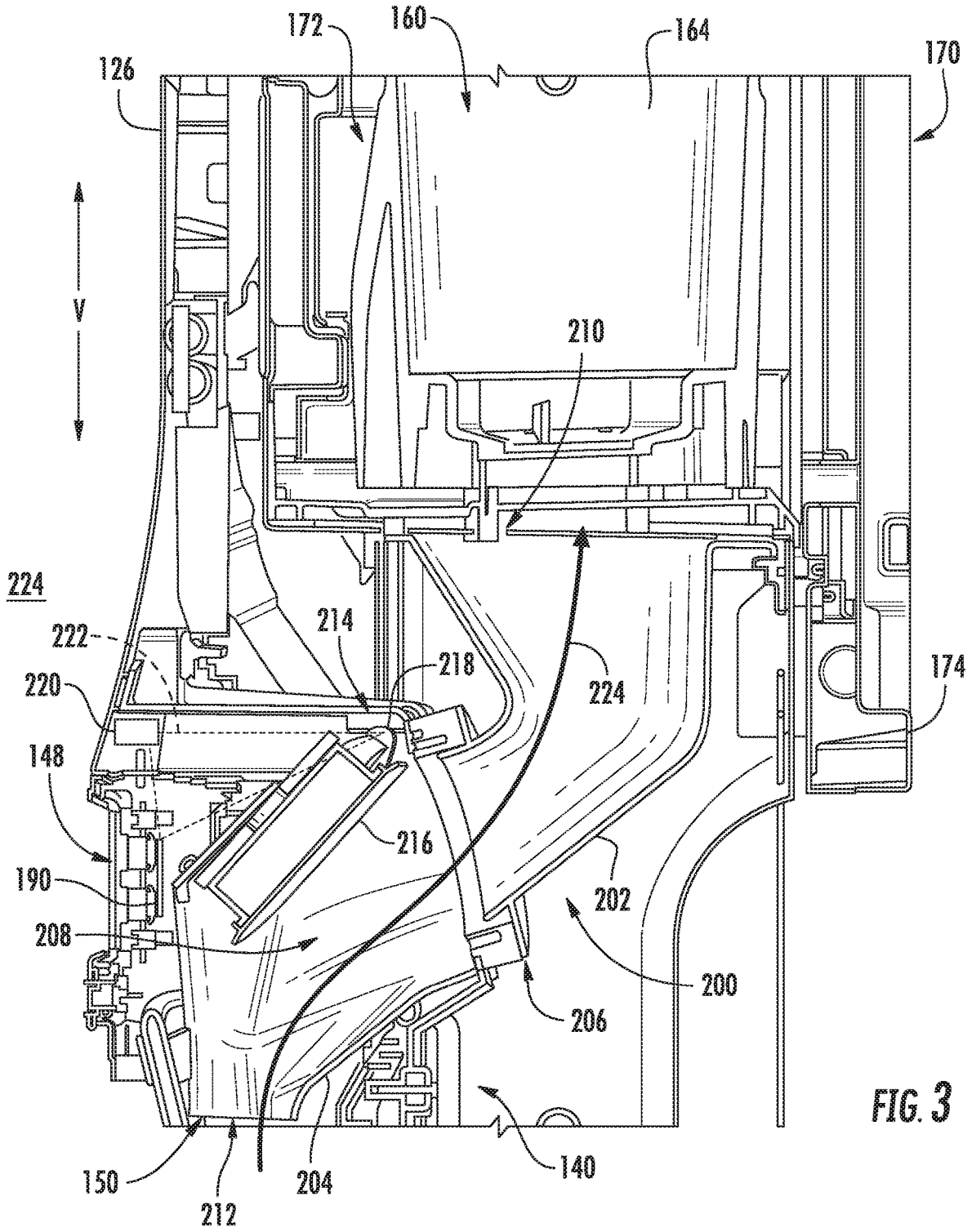
FIG. 3 provides a section view of a dispenser assembly of the exemplary refrigerator appliance of FIG. 1 according to exemplary embodiments of the present subject matter.

FIG. 3 provides a section view of dispenser assembly 140 of refrigerator appliance 100 of FIG. 1 according to exemplary embodiments of the present subject matter. As may be seen in FIG. 3, dispensing assembly 140 includes a dispenser conduit 200 positioned at least partially within refrigerator door 126. Dispenser conduit 200 includes a top piece or portion 202 (i.e., an ice chute) and a bottom piece or portion 204 (i.e., an ice funnel) that are connected or joined together at a joint 206. It should be understood that dispenser conduit 200 shown in FIG. 3 is provided by way of example only and that, in alternative exemplary embodiments, dispenser conduit 200 may be formed as a single piece or as more than two pieces, e.g., three, four or more pieces.

Dispenser conduit 200 defines an inner volume 208. Inner volume 208 of dispenser conduit 200 is configured for directing ice from ice making assembly 160 to dispenser recess 150. In particular, inner volume 208 of dispenser conduit 200 extends between an inlet 210 and an outlet 212. Inlet 210 of inner volume 208 is positioned at or adjacent ice making assembly 160, and outlet 212 of inner volume 208 is positioned at or adjacent a top portion of dispenser recess 150, e.g., and defines or forms discharging outlet 144 (FIG. 1). Inlet 210 is in fluid or airflow communication with compartment 170 and more particularly with ice making assembly 160 housed within interior chamber 172 of compartment 170, and thus, inner volume 208 of dispenser conduit 200 is also in fluid communication with freezer chamber 124 via duct 176 (FIG. 2).

Inlet 210 of inner volume 208 may be positioned above outlet 212 of inner volume 208 along the vertical direction V, e.g., such that gravity urges ice nuggets (not shown) from an ice storage bin 164 of ice making assembly 160 into and through inner volume 208 of dispenser conduit 200 to outlet 212 of inner volume 208. Inlet 210 of inner volume 208 may also be offset from outlet 212 of inner volume 208 along a direction that is perpendicular to the vertical direction V (i.e., the horizontal direction H and/or the transverse direction T). Inlet 210 of inner volume 208 may also have a larger cross-sectional area (e.g., in a plane that is perpendicular to the vertical direction V) than outlet 212 of inner volume 208. Thus, dispenser conduit 200 may funnel ice nuggets through inner volume 208 of dispenser conduit 200 from inlet 210 of inner volume 208 to outlet 212 of inner volume 208. Outlet 212 of inner volume 208 may also have a circular shape, e.g., in a plane that is perpendicular to the vertical direction V, in certain exemplary embodiments.

A duct door assembly 214 includes a duct door 216 and a motor 218. Duct door assembly 214 is positioned within dispenser conduit 200, e.g., at or adjacent joint 206 between top portion 202 and bottom portion 204 of dispenser conduit 200. Duct door 216 is selectively adjustable (e.g., rotatable) via motor 218 between an open position shown in FIG. 3 and a closed position (not shown). In the closed position, duct door 216 is positioned between dispenser recess 150 and compartment 170. Thus, duct door 216 may block or hinder airflow between dispenser recess 150 and compartment 170 and reduce heat transfer between dispenser recess 150 and compartment 170. Conversely, in the open position, duct door 216 is not positioned between dispenser recess 150 and compartment 170. Thus, ice nuggets from ice making assembly 160 may flow through inner volume 208 to outlet 212 of inner volume 208. Duct door 216 may normally be biased in the closed position via a spring (not shown) and may shift to the open position when a user operates actuating mechanism 146 (FIG. 1). Dispenser conduit 200 may be sized and shaped, e.g., with a recess, for permitting movement or rotation of duct door 216 between the open and closed positions within dispenser conduit 200.

With reference still to FIG. 3, refrigerator appliance 100 includes a proximity sensor 220 for sensing one or more users within proximity of refrigerator appliance 100. Proximity sensor 220 can be any suitable type of sensor. Exemplary sensor types include: infrared, sonar, camera, heat signature sensors, or some combination of the foregoing. For this embodiment, proximity sensor 220 is an infrared sensor. Proximity sensor 220 can be positioned in any suitable location on or integral with refrigerator appliance 100. By way of example, proximity sensor 220 can be located at or adjacent user interface panel 148, dispenser recess 150, any door 126, 128, 130, or in other suitable locations of refrigerator appliance 100. For this embodiment, proximity sensor 220 is positioned adjacent user interface panel 148 within refrigerator door 126. In alternative exemplary embodiments, proximity sensor 220 can be located or positioned in an off board location. For example, proximity sensor 220 can be a camera mounted adjacent a ceiling of a kitchen in which refrigerator appliance 100 is positioned.

As shown in FIG. 3, controller 190 is in operative communication (shown by dashed communication lines 222) with proximity sensor 220 and motor 218 of duct door assembly 214. In this way, when proximity sensor 220 detects users within proximity of refrigerator appliance 100, a signal or communication is sent to controller 190 that a user has been detected. Controller 190 may then communicate with motor 218 to actuate duct door 216 to an open position. When duct door 216 is in the open position, ambient air 224 surrounding refrigerator appliance 100 is permitted to flow into and through inner volume 208 of dispenser conduit 200 as shown. Ambient air 224 continues to flow through inlet 210 and into and through compartment 170. Although not shown, ambient air 224 then flows into and through duct 176 and finally into freezer compartment 124 (FIG. 2). With the introduction of the relatively higher pressure ambient air 224 flowing into freezer compartment 124, the pressure differential between the interior air of freezer compartment 124 and surrounding ambient air 224 is reduced, breaking the vacuum between freezer chamber 124 and ambient air 224. In this manner, the freezer door opening force is reduced. Stated alternatively, when duct door 216 is in the open position, freezer compartment 124 is in fluid communication with the atmosphere or air that is exterior to appliance 100 through dispenser conduit 200. When duct door 216 is in the closed position, freezer compartment 124 is not in fluid communication with the atmosphere or air that is exterior to appliance 100 through dispenser conduit 200.

In some exemplary embodiments, controller 190 is in operative communication with fan 177 (FIG. 2). When duct door 216 is actuated to the open position, controller 190 can be configured to activate fan 177 such that fan 177 draws ambient air 224 into freezer chamber 124. In this way, the higher pressure ambient air 224 can be ushered more quickly into freezer chamber 124 and thus the pressure differential may be equalized faster and more efficiently.

In other alternative embodiments, controller 190 may be integral with motor 218 or motor 218 may have circuitry capable of sensing signals sent directly from proximity sensor 220 such that communications can be sent directly from proximity sensor 220 to motor 218 for actuating duct door 216.

Figure 4:
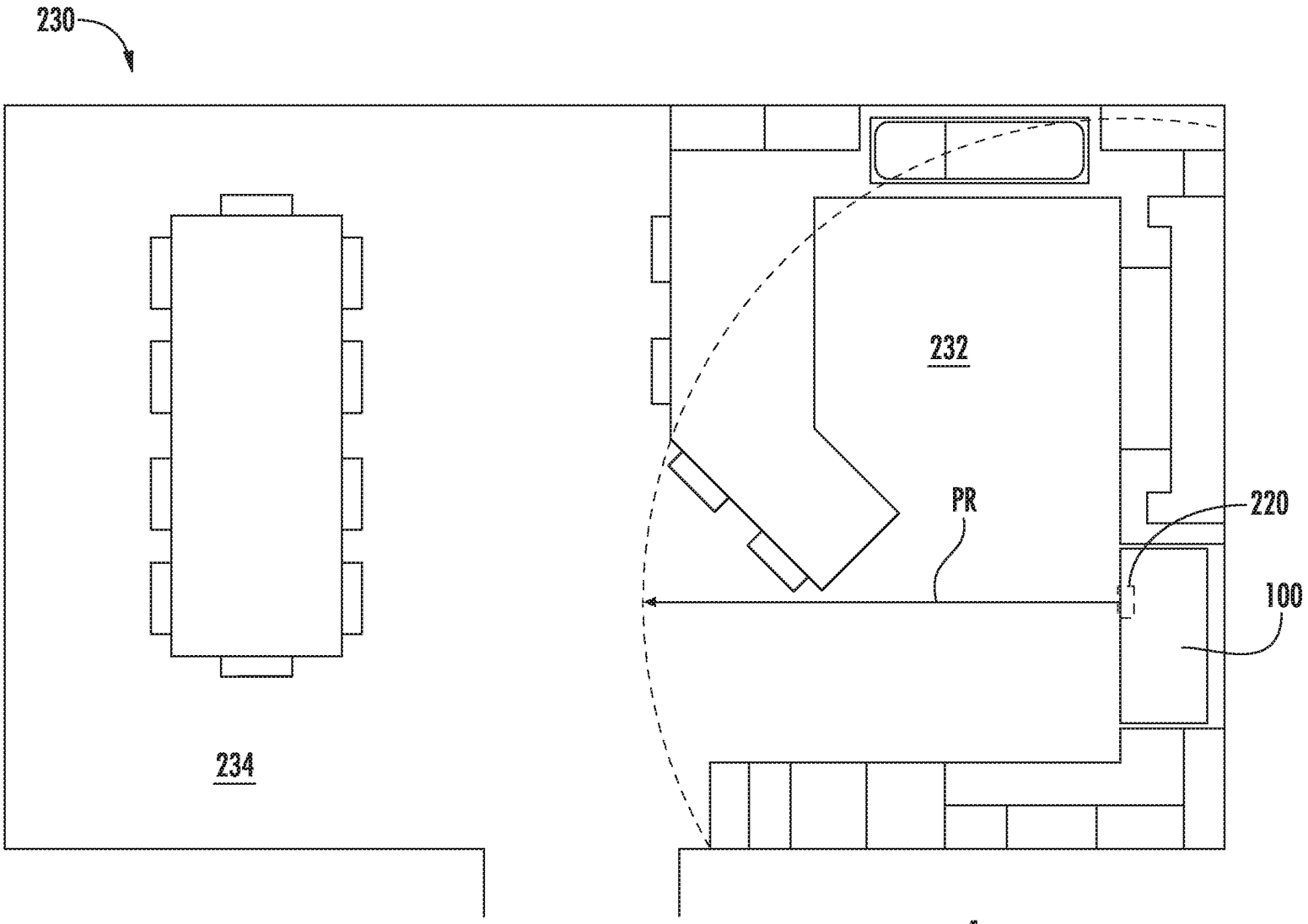
FIG. 4 provides a top, plan view of an exemplary floor plan depicting a proximity range of refrigerator appliance of FIG. 1 according to exemplary embodiments of the present subject matter.

FIG. 4 provides a top plan view of an exemplary floor plan 230 depicting a proximity range PR of refrigerator appliance 100 of FIG. 1 according to exemplary embodiments of the present subject matter. As shown, floor plan 230 includes a kitchen 232 and a dining room 234 oriented in an open concept living room-dining room combination. Proximity range PR of proximity sensor 220 extends outwardly from refrigeration appliance 100 as shown. For this embodiment, proximity range PR of proximity sensor 220 is tuned such that proximity sensor 220 detects users within range when the user first enters kitchen 232. It will be appreciated that proximity range PR of proximity sensor 220 can be tuned to fit the floor plan of a particular users' dwelling or structure, or more generally, proximity range PR can be tuned as desired. For example, proximity range PR of proximity sensor 220 of refrigerator appliance 100 can be tuned to extend into the dining room 234 of the present example. In other exemplary embodiments, proximity range PR extends from refrigerator appliance 100 at least about six (6) feet, at least about ten (10) feet, at least about fifteen (15) feet, or at least about a distance that extends to a predetermined location, e.g., the entrance of the kitchen.

Figure 5:
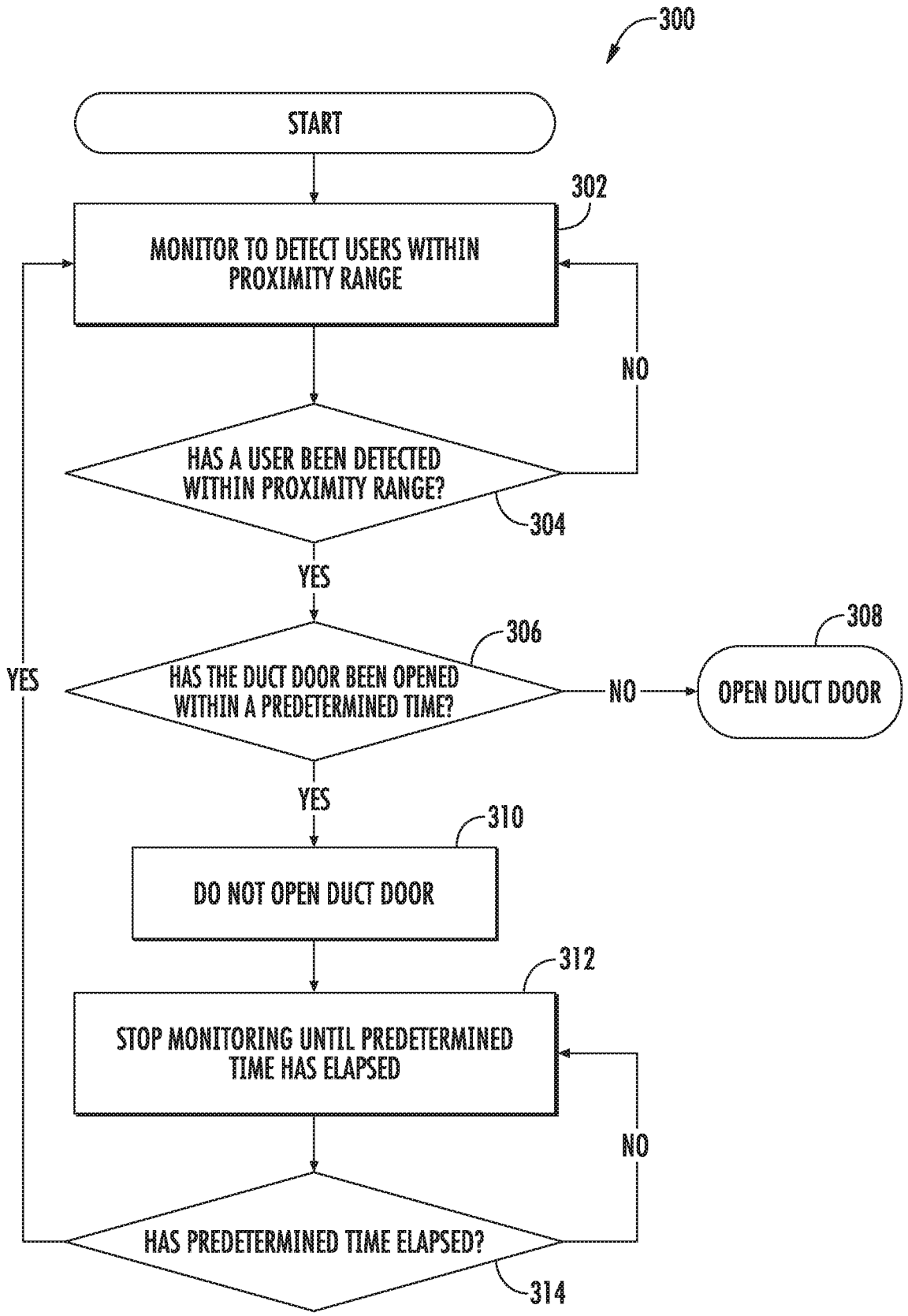
FIG. 5 provides an exemplary flow chart of operation of refrigerator appliance of FIG. 1 according to exemplary embodiments of the present subject matter.

FIG. 5 provides an exemplary flow diagram of an exemplary method (300) for operation of refrigerator appliance 100 of FIG. 1 according to exemplary embodiments of the present subject matter. FIG. 5 depicts method (300) in a particular order for purposes of illustration and discussion. However, it will be appreciated that exemplary method (300) can be modified, adapted, expanded, rearranged and/or parts of method (300) can be omitted in various ways without deviating from the scope of the present subject matter.

At (302), exemplary method (300) includes monitoring for users within proximity range PR of refrigerator appliance 100. Proximity sensor 220 can be configured to monitor for users within proximity range PR continuously, or alternatively, proximity sensor 220 can be configured to monitor for users within proximity range PR of refrigerator appliance 100 at certain intervals, e.g., every five seconds, every ten seconds, etc.

At (304), exemplary method (300) includes detecting a user within proximity range PR of refrigerator appliance 100. If a user has not been detected within proximity range PR of refrigerator appliance 100, proximity sensor 220 continues monitoring for users within proximity range PR at (302).

At (306), if a user is detected within proximity range PR of refrigerator appliance 100 at (304), controller 190 or other timing device determines whether duct door 216 has been opened within a predetermined time. As explained more fully below, depending on the determination, duct door 216 is either actuated to the open position at (308) or duct door 216 remains in the closed position at (310). Limiting the actuation of duct door 216 to an open position (as shown in FIG. 3) may prevent unnecessary and inadvertent actuation of duct door 216, and consequently, refrigerator appliance 100 can save energy whilst still being capable of reducing the freezer door opening force.

At (308), if duct door 216 has not been opened within a predetermined time as determined at (306), refrigerator appliance 100 opens duct door 216 for a predetermined open time. For example, controller 190 may provide a communication to activate motor 218 to actuate duct door 216 to the open position. For this exemplary embodiment, the predetermined open time is about five (5) seconds. Opening duct door 216 allows for ambient air 224 to flow through dispenser conduit 200, through compartment 170, through duct 176, and into freezer chamber 124 to equalize or reduce the pressure differential between the air within freezer chamber 124 and ambient air 224.

In other exemplary embodiments, the predetermined open time is at least about one (1) second, at least about two (2) seconds, at least about three (3) seconds, at least about four (4) seconds, at least about six seconds (6), and at least about seven (7) seconds. In another exemplary embodiment, duct door 216 is opened for a predetermined open time between about two (2) to about ten (10) seconds. In yet another embodiment, duct door 216 is opened for a predetermined open time between about three (3) to about five (5) seconds. In other embodiments, the predetermined open time corresponds with a time in which it takes the pressure differential to be reduced such that the freezer door opening force is less than or equal to about fifteen (15) $lb_f$.

In yet other exemplary embodiments, the predetermined open time may be tuned to correspond with a time in which the pressure within freezer chamber 124 of refrigerator appliance 100 is substantially equalized with the pressure of ambient air 224 surrounding refrigerator appliance 100. For such an embodiment, substantially equalized corresponds to a pressure differential margin between the interior pressure of freezer chamber 124 and the surrounding ambient air 224 that is less than about five percent (5%). Stated alternatively, when the pressure of the air within freezer chamber 124 is within about five percent (5%) of the pressure of ambient air 224 surrounding refrigerator appliance 100, the pressure within freezer chamber 124 and ambient air 224 may be deemed substantially equalized. In other embodiments, substantially equalized corresponds to a pressure differential margin between the interior pressure of freezer chamber 124 and the surrounding ambient air 224 that is less than about ten percent (10%), less than about fifteen percent (15%), less than about twenty percent (20%), and less than about thirty percent (30%). In the exemplary embodiments noted above, refrigerator appliance 100 may include one or pressure sensors (not shown) for measuring the pressure of the interior air of freezer chamber 124 and the pressure of the surrounding ambient air 224. Alternatively, refrigerator appliance 100 may include other types of sensors capable of providing inputs to controller 190 for deriving calculated or predicted pressure readings of freezer chamber 124 and ambient air 224.

At (310), if duct door 216 has been opened within the predetermined time as determined at (306), duct door 216 is not opened upon detection of the user within proximity range PR of refrigerator appliance 100. Controller 190 or like timing device can make the determination at (306). Then, controller 190 can perform at least one of the following if duct door 216 has been opened within the predetermined time: controller 190 can instruct motor 218 to keep duct door 216 closed at least until after the predetermined time has elapsed, or refrain from activating motor 218 to open duct door 216 at least until after the predetermined time has elapsed. Stated alternatively, controller 190 can either actively communicate with motor 218 not to open duct door 216 or controller 190 can simply not send a communication to motor 218.

Keeping duct door 216 in the closed position (i.e., sealed against joint 206 to prevent air leakage from discharging outlet 144) when it is determined that duct door 216 has been opened within the predetermined time can have a number of benefits. In one respect, if duct door 216 has been opened within the predetermined time, duct door 216 remains or is kept closed to prevent unnecessary actuation of duct door 216. That is, the pressure differential between freezer chamber 124 and the ambient surrounding air 224 may not have had time to increase or build up to an undesirable differential. Thus, opening duct door 216 in this situation may only minimally reduce the freezer door opening force, and accordingly, opening duct door 216 may be unnecessary in this situation.

In another regard, duct door 216 is not opened if it has been opened within the predetermined time to prevent unnecessary energy loss from refrigerator appliance 100. That is, the more times duct door 216 is opened, the more chilled air that escapes refrigerator appliance 100. In this way, refrigerator appliance 100 is required to perform more work to maintain the desired temperatures within the various chambers 122, 124 and compartment 170 of refrigerator appliance 100. These energy losses are unnecessary in that, as noted above, opening duct door 216 where it has already been opened within the predetermined time may only minimally reduce the freezer door opening force. In yet another regard, inadvertent actuation of duct door 216 is minimized as duct door 216, in this embodiment, is only opened if controller 190 determines that duct door 216 has not been opened within the predetermined time. In this way, if a user is walking back and forth between the kitchen and dining room, such as those of FIG. 4, duct door 216 is not constantly opened and closed. As noted above, this might result in unnecessary energy losses with minimal or negligible benefit in reduction of the freezer door opening force.

The predetermined time can be set and tuned to various times. The setting of the predetermined time can be influenced by a number of factors, such as the integrity of the sealing elements of freezer door 130 and lip 196 of housing 120, the efficiency of the sealed system of refrigerator appliance 100 to cool ambient air 224, and the weight of freezer door 130, for example. For this embodiment, the predetermined time is at least about thirty (30) minutes. For other exemplary embodiments, the predetermined time is at least about sixty (60) minutes, at least about forty-five (45) minutes, at least about twenty (20) minutes, or at least about fifteen (15) minutes.

In some exemplary embodiments, the predetermined time is tunable by controller 190 depending on the sensed, measured, predicted, or calculated pressure differential between an interior volume of air within freezer chamber 124 and ambient air 224 surrounding refrigerator appliance 100. For instance, the predetermined time can correspond to a time in which the pressure differential between the interior volume of air within freezer chamber 124 and surrounding ambient air 224 has met a predetermined pressure differential threshold. The predetermined pressure differential threshold can be set to any suitable value or margin and can be tuned or adapted in real time. By way of example, the predetermined pressure differential threshold can be set to a value where the margin between the pressure of the air within freezer chamber 124 and the pressure of ambient air 224 is greater than or equal to about ten percent (10%). That is, when the margin between the pressure of the air of freezer chamber 124 and the pressure of ambient air 224 is greater than or equal to about ten percent (10%), the predetermined pressure differential threshold is met, and when the threshold is met, this corresponds with the predetermined time. In this way, duct door 216 is actuated to an open position when opening duct door 216 will have a meaningful impact on the freezer door opening force. It will be appreciated that other suitable margins or values for the threshold are also contemplated, such as when the margin between the air within freezer chamber 124 and ambient air 224 is greater than or equal to about, e.g., a twenty percent margin (20%), a thirty percent margin (30%), a forty percent margin (40%), a fifty percent margin (50%), etc.

At (312), if duct door 216 has been opened within a predetermined time as determined at (306) and duct door is not opened at (310), proximity sensor 220 is instructed to stop or cease monitoring until the predetermined time has elapsed. In other exemplary embodiments, proximity sensor 220 can be configured to continue to monitor for users within proximity range PR of refrigerator appliance 100, but controller 190 can be programmed in such a way that duct door 216 is not opened until the predetermined time has elapsed.

At (314), exemplary method (300) includes determining whether the predetermined time has elapsed. If the predetermined time has elapsed, proximity sensor 220 continues to monitor for users within proximity range PR of refrigerator appliance 100 at (302) and exemplary method (300) proceeds forward as set forth above. If the predetermined time has not elapsed, proximity sensor 220 ceases or stops monitoring for users within proximity range PR as set forth at (312).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a housing including a freezer chamber;

a freezer door supported by the housing and providing for selective access to the freezer chamber;

a duct door in fluid communication with the freezer chamber and selectively adjustable between an open and a closed position, wherein in the open position, the freezer chamber is in fluid communication with air exterior to the refrigerator appliance, and in the closed position, the freezer chamber is not in fluid communication with air exterior to the refrigerator appliance;

a motor configured to actuate the duct door between the open and the closed position;

a proximity sensor for detecting users within a proximity range of the refrigerator appliance, the proximity sensor in operative communication with the motor; wherein when the proximity sensor detects a user within the proximity range, the motor is configured to actuate the duct door to the open position for a predetermined open time;

a controller in operative communication with the proximity sensor and the motor, the controller configured to:

obtain a communication from the proximity sensor that the user is within proximity range of the refrigerator appliance; and activate the motor to open the duct door for the predetermined open time when the proximity sensor detects the user within the proximity range, a fresh food door a dispensing assembly positioned on or in the freezer door or the fresh food door and comprising a dispenser having a dispenser conduit extending between an inlet and an outlet, the outlet defining a discharging outlet of the dispenser that is open to ambient air surrounding the refrigerator appliance, the duct door positioned within the dispenser conduit;

a duct for providing fluid communication between the freezer chamber and the inlet of the dispenser conduit; and a fan positioned within the duct and in operative communication with the controller; wherein, when the motor is activated to open the duct door, the controller is further configured to activate the fan to draw the ambient air passed the open duct door and to the freezer chamber.

2. The refrigerator appliance of claim 1, wherein the controller is further configured to:

determine whether the duct door has been opened within a predetermined time prior to activating the motor to open the duct door for the predetermined open time;

perform at least one of the following if the duct door has been opened within the predetermined time: (i) instruct the motor to keep the duct door closed at least until after the predetermined time has elapsed; and (ii) refrain from activating the motor to open the duct door at least until after the predetermined time has elapsed.

3. A refrigerator appliance, comprising:

a housing including a freezer chamber and fresh food chamber;

a door providing selective access to either the freezer chamber or the fresh food chamber;

a duct door located in the door, the duct door in fluid communication with the freezer chamber and selectively adjustable between an open and a closed position, wherein in the open position, the freezer chamber is in fluid communication with air exterior to the refrigerator appliance, and in the closed position, the freezer chamber is not in fluid communication with air exterior to the refrigerator appliance;

a motor configured to actuate the duct door between the open and the closed position;

a proximity sensor for detecting users within a proximity range of the refrigerator appliance, the proximity sensor in operative communication with the motor; wherein when the proximity sensor detects a user within the proximity range, the motor is configured to actuate the duct door to the open position for a predetermined open time; and a controller in operative communication with the proximity sensor and the motor, the controller configured to:

obtain a communication from the proximity sensor that the user is within proximity range of the refrigerator appliance;

activate the motor to open the duct door for the predetermined open time when the proximity sensor detects the user within the proximity range; wherein the refrigerator appliance further comprises:

a dispensing assembly positioned on or in the door and comprising a dispenser having a dispenser conduit extending between an inlet and an outlet, the outlet defining a discharging outlet of the dispenser that is open to ambient air surrounding the refrigerator appliance, the duct door positioned within the dispenser conduit;

a duct for providing fluid communication between the freezer chamber and the inlet of the dispenser conduit; and a fan positioned within the duct and in operative communication with the controller; wherein, when the motor is activated to open the duct door, the controller is further configured to:

activate the fan to draw the ambient air passed the open duct door and to the freezer chamber.

4. The refrigerator appliance of claim 3, wherein the controller is further configured to:

determine whether the duct door has been opened within a predetermined time prior to activating the motor to open the duct door for the predetermined open time;

perform at least one of the following if the duct door has been opened within the predetermined time: (i) instruct the motor to keep the duct door closed at least until after the predetermined time has elapsed; and (ii) refrain from activating the motor to open the duct door at least until after the predetermined time has elapsed.

* * * * *